US005653047A

United States Patent [19]

Franey

[11] Patent Number: 5,653,047

[45] Date of Patent: Aug. 5, 1997

[54] SOLID STATE ESD FOOTWEAR

[75] Inventor: John Philip Franey, Bridgewater, N.J.

[73] Assignee: Lucent Technologies Inc., Murray Hill, N.J.

[21] Appl. No.: 535,603

[22] Filed: Sep. 28, 1995

[51] Int. Cl.[6] ..... A43B 23/00; A43B 13/00

[52] U.S. Cl. ..... 36/136; 36/25 R; 36/30 R; 361/223; 361/224

[58] Field of Search ..... 36/1 R, 25 R, 36/30 R, 136; 361/223, 224

[56] References Cited

U.S. PATENT DOCUMENTS

| | | | |
|---|---|---|---|
| 497,822 | 5/1893 | Royer | 361/223 |
| 2,710,366 | 6/1955 | Stern, Jr. et al. | 36/1 R |
| 2,712,099 | 6/1955 | Legge | 36/1 R |
| 2,857,556 | 10/1958 | Price | 36/1 R |
| 3,293,494 | 12/1966 | Fischer | 36/1 R |
| 4,366,630 | 1/1983 | Bloom | 36/30 R |
| 4,785,371 | 11/1988 | Edwards | 361/223 |
| 5,154,886 | 10/1992 | Franey | 422/8 |

*Primary Examiner*—M. D. Patterson

[57] ABSTRACT

A static dissipative shoe which is provided utilizes a polymer material embedded therein, so that the handling, shipping and storage of integrated circuits are protected from electrostatic discharge. A conductive plug in communication with the outsole and static interceptor fabricated from a non volatile material having a conductivity of less that about $10^5$ ohms and which is located in the toe region of the outsole, provides a conductive path to the static interceptor layer. The footwear includes a toe and heel region, a conductive layer having an upper surface and a lower surface, the lower surface of the conductive layer arranged proximate the upper surface of the outsole and upper surface of the conductive plugs for providing a continuous path from the outside of the footwear to the static interceptor means. Additionally, static interceptor means, which provides for the controlling of the rate of discharging, has an upper surface and a lower surface arranged proximate the upper surface of the conductive layer and the lower surface of an upper conductive layer.

16 Claims, 1 Drawing Sheet

SOLID STATE ESD FOOTWEAR

FIELD OF THE INVENTION

This invention relates generally to protection of sensitive electronic devices such as integrated circuits and, in particular, to footwear which provides for discharge of electrostatic voltage potentials.

BACKGROUND OF THE INVENTION

Integrated circuits and their assemblages are typically handled, shipped, and stored in packaging material such as rigid containers, plastic bubble holders sealed with a plastic tape (denominated "tape and reel carriers") plastic bags, and polymer foam. For a wide variety of integrated circuits, electrostatic charge/discharge and possibly corrosion protection must be provided to avoid destruction or serious degradation of the integrated circuit during storage, shipping and use. Static electricity discharges from a person to a device being handled (an occurrence common during the winter season) is often sufficient to produce such damage. For example, it has been found that factory workers can generate electrostatic potentials in excess of 20,000 volts simply by walking on a factory floor. The friction between the sole of the footwear and the floor material causes a high siatic smile voltage potential to develop on the worker. If the worker comes into close proximity to an electrostatic sensitive device, the charged worker can cause a discharge to the device and consequently damage the product.

Various means have been attempted to provide electrostatic or corrosion protection. The first such device is a dissipative strap which is placed around the user's ankle or in the shoe and which remains in contact with the heel. When the user generates an electrostatic potential by walking on a floor, the charge is substantially neutralized by the heel grounding device. However, some of the problems with this device include user's failure to properly attach the device to the ankle and heel; failure of electrical component due to wear; or irregular walking, which reduces the effectiveness of the device since the grounding device may not work properly until the heel comes into sufficient contact with the floor.

A second type of device is a static dissipative shoe. Typically, these shoes fall in the electrostatic discharge range of $10^6$ to $10^9$ ohms/sq when measuring resistance from the bottom of the sole to the inside sock surface. To date, the shoe construction has relied on shoes filled with volatile organic compounds to create a static dissipative resistivity. Such organic compounds evaporate with time and rely on atmospheric moisture to provide the electrostatic dissipative characteristics. Moreover, the organic evaporation considerably limits the useful life of the device. Accelerated evaporation can occur from leaching into carpets, storage in high temperature conditions, walking on hot surfaces and walking in water such as rain puddles. As well, in dry environments or high altitudes the evaporation rate of the organic may be accelerated.

SUMMARY OF THE INVENTION

The use of a specific polymer guard for electrostatic sensitive portions of an integrated circuit device yields excellent protection and in certain embodiments also yields corrosion inhibition. In particular, a polymer matrix, e.g. polyethylene, is formed into a flexing sheet configuration such as a static protective layer which is inserted into the sole of a shoe. This polymer matrix is formulated to include impregnated particles of carbon black and of a metal that undergoes chemical bonding with the carbon and possibly also with the polymer. Carbon black is defined as a finely divided form of carbon such as that obtained by the incomplete combustion of natural gas. For electrostatic protection, exemplary carbon blacks have high specific surface areas (preferably at least 750 $m^2/g$, measured by the $N_2$BET method)and large pore volume (preferably at least 200 ml/100 g). Examples of suitable metals are transition metals such as copper, iron, cobalt, manganese and alloys of these metals. Examples of such a polymer matrix is shown and described in U.S. Pat. No. 5,154,886, the disclosure of which is incorporated herein by reference.

In accordance with an aspect of the invention an electrostatic discharge ("ESD") device is provided with an outsole, the outsole having an upper surface and a lower surface, the outsole including a toe region and a heel region. Static interceptor means are arranged proximate the upper surface of the outsole and are provided having an upper surface and a lower surface with the lower surface of the static interceptor means arranged adjacent the upper surface of the conductive layer. A conductive plug is provided which is in communication with the outsole and the static interceptor in order to controllably discharge any high static voltage which develops on the worker.

The conductive plug is a resilient material fabricated out of a polymer matrix and protrudes slightly above and below the outsole to provide a stable contact with both the ground and the static interceptor surface on the inside of the shoe. The conductive plug provides a continuous electrical path from the outside of the shoe to the static interceptor layer which is provided with a composition of non volatile dissipative resistance in the range of $10^5$ to $10^6$ ohms to maintain the shoe electrical characteristics at the proper resistance. One or more conductive plugs can be placed in the front portion of the outsole. In this way, electrical contact with the floor is maintained through most of the walking motion of the worker.

BRIEF DESCRIPTION OF THE DRAWINGS

The preferred embodiment of the invention will be explained in further detail and in reference to the drawings, in which.

DETAILED DESCRIPTION OF THE PRESENTLY PREFERRED EMBODIMENTS

Figure 1:
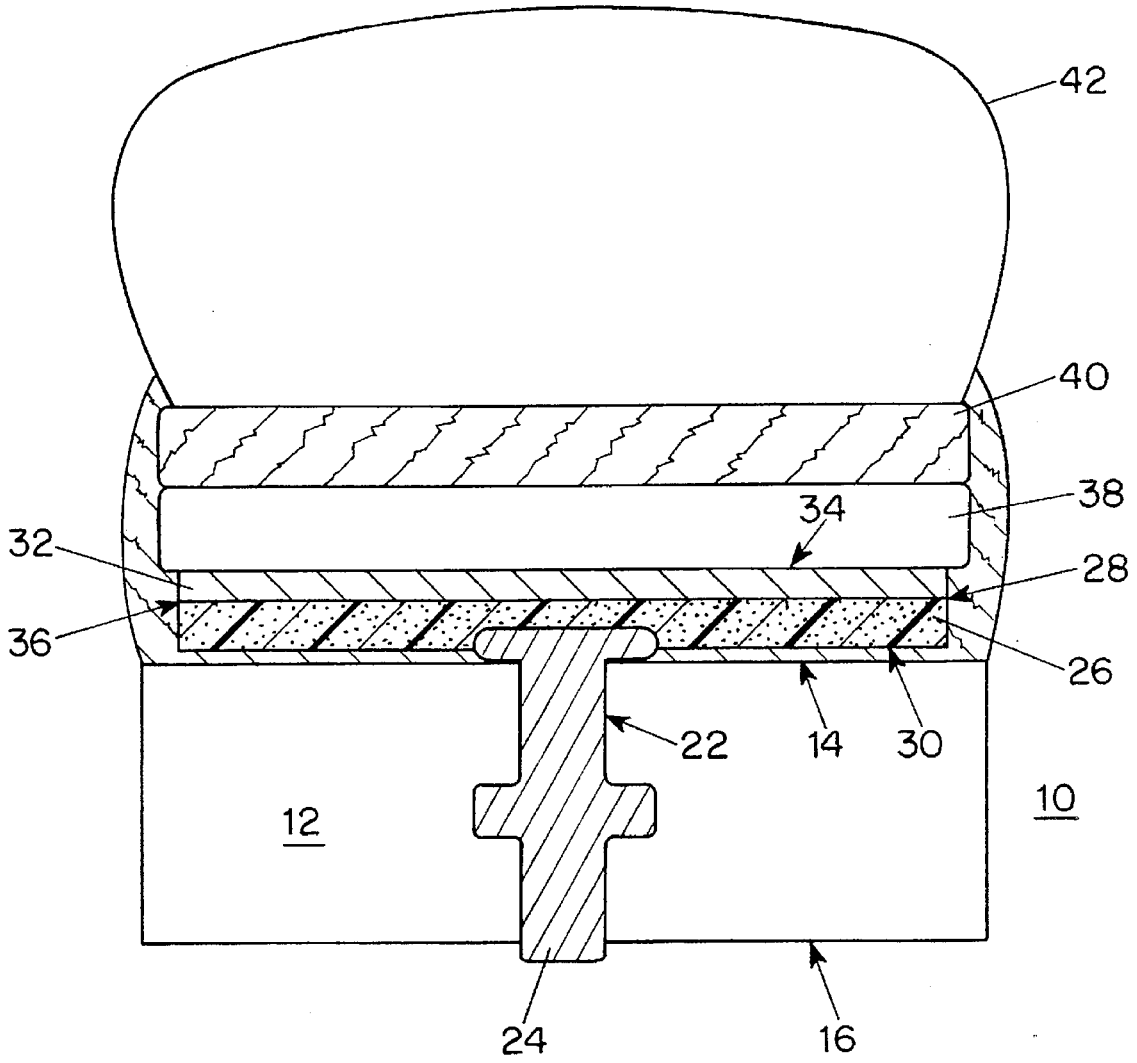
FIG. 1 is a cross-sectional side view of a shoe constructed in accordance with a presently preferred embodiment of the invention.
Figure 2:
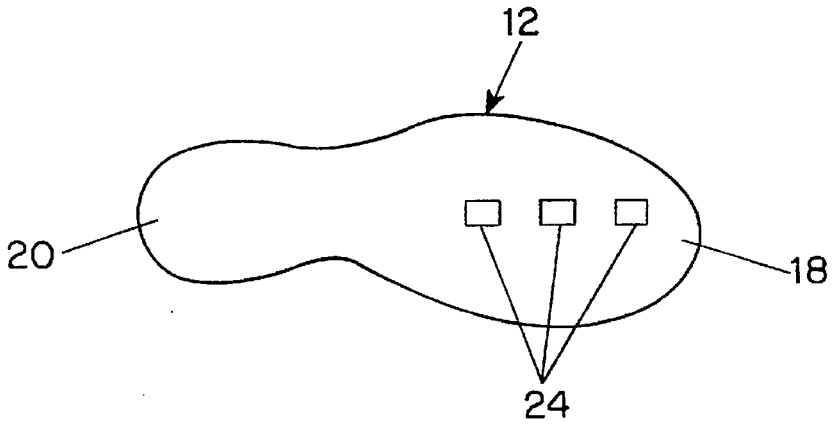
FIG. 2 is a bottom view of a shoe outsole showing a plurality of conductive plugs.

Referring to FIG. 1, a cross-sectional side view of one embodiment in accordance with the present inventive electrostatic dissipative footwear 10 is shown. However, the invention is not limited in scope in this respect. For example, the exact type and style of the footwear is not critical provided the footwear or shoe 10 makes contact with the ground and supports a wearer's foot. The static dissipative shoe is provided with an outsole 12 having an upper surface 14 and a lower surface 16. The lower surface 16 contacts with the floor when a user is walking. As shown in FIG. 2, the outsole 12 includes a toe region 18 and a heel region 20 as is standard in any outsole shoe construction. Typically, the outsole 12 is constructed from a poly foam material, although any suitable cushion material may be utilized. The outsole 12 is provided with one or more openings 22 (FIG.

1) so that a conductive plug 24 may be inserted therein, or, the plug may be molded into the outsole 12 during manufacturing.

Conductive plug 24 is constructed from a conductive material having a conductivity of less than $10^5$ ohms. Typically, the conductive plug may be fabricated from a polymer matrix containing conductive carbon. Conductive plug 24 is a resilient material. In accordance with this particular embodiment, conductive plug 24 protrudes slightly above the upper surface 14 of the outsole 12 and below the lower surface 16 of the outsole 12 in order to provide stable contact with both the ground and a conductive layer or conductive foam cushion surface 26 on the inside of shoe 10. Although the invention is not limited in scope in this respect, the conductive layer 26 is provided with an upper surface 28 and a lower surface 30. Lower surface 30 of conductive layer 26 is arranged proximate upper surface 14 of outsole 12.

Static interceptor means or a static interceptor layer 32 is provided which has a composition of a non volatile dissipative resistance in a preferable range of $10^5$ to $10^9$ ohms in order to maintain the electrical characteristics of the shoe to a proper resistance. In an embodiment of the invention, the resistance of the layer 32 is substantially equal to $10^6$ ohms. This static interceptor layer 32 may be fabricated out of a polymer matrix previously referenced in U.S. Pat. No. 5,154,886. Static interceptor layer 32 is provided with an upper surface 34 and a lower surface 36. Lower surface 36 of static interceptor layer 32 is arranged proximate to upper surface 28 of said conductive layer 26. Also as shown in FIG. 1, shoe 10 may be provided with a layer 38 made of a conductive cardboard type material and a layer 40 made of a fibrous cushioning material, which may both be used as the last two inner layer of shoe 10, although the material is not limited in scope in this respect.

Typically, the conductive plug has a diameter of approximately 0.5 cm. In the embodiment shown in FIG. 2, three conductive plugs are placed in the front toe region 18 of outsole 12 approximately one, two and three inches from the toe of shoe 10. Although conductive plugs 24 shown in FIG. 2 are in a linear arrangement, any suitable geometric arrangement may be utilized as along as the positioning of conductive plugs 24 allows the wearer to maintain sufficient electrical contact with the floor through most of the walking motion.

When a user wears footwear 10 and an electrostatic potential is generated by walking, conductive plugs 24 allow the user to maintain proper electrical contact with the floor through most of the user's walking motion. In this way, conductive plug 24, which provides a stable contact with both the ground and the conductive foam cushion surface 26 on the inside of the shoe, provides a continuing electrical path from the outside of the shoe through the static interceptor layer 32 to the top of cushioning material 40. In this way, when the user walks on a static dissipate floor, the charge is safely neutralized through the static interceptor layer 32. Specifically, as a person walks, the friction created by the sliding contact of the bottom of the shoe with the floor generates a static charge. This charge is additive and can rapidly increase, greatly creating a corresponding high voltage in excess of 25,000 volts. If a person comes in contact with, or in the vicinity of an electrostatic sensitive device, a damaging discharge can occur. As the person walks with this new shoe design, the charge can flow controllably through the static interceptor layer and conductive layers to charge neutralizing areas on the floor, thus neutralizing the charge.

It should be understood that the preferred embodiments and examples described are far illustrative purposes only and are not to be construed as limiting the scope of the present invention which is properly delineated only in the appended claims.

What is claimed is:

1. A static dissipative footwear comprising:

an outsole having an upper surface and a lower surface, said outsole including a toe region and a heel region;

a first conductive layer having an upper surface and a lower surface, said lower surface of said conductive layer arranged proximate said upper surface of said outsole;

static interceptor means having an upper surface and a lower surface, said lower surface of said static interceptor means arranged proximate said upper surface of said first conductive layer, said static interceptor layer comprising a polymer matrix containing conductive carbon and a transition metal; and a conductive plug in communication with said outsole and said static interceptor means.

2. The footwear of claim 1 further comprising a second conductive layer arranged proximate said upper surface of said static interceptor means, said second conductive layer having a conductivity of less than $10^4$ ohms.

3. The footwear of claim 1 further comprising a third conductive layer arranged proximate the upper surface of said second conductive layer, said third conductive layer having a conductivity of less than $10^4$ ohms.

4. The footwear of claim 1 wherein said conductive plug is fabricated from a polymer matrix containing conductive carbon and a transition metal.

5. The footwear of claim 1 wherein said conductive plug is located in said toe region of said outsole, said conductive plug having a diameter of approximately 0.5 cm.

6. The footwear of claim 5 wherein a plurality of conductive plugs are located in said toe region of said outsole.

7. The footwear of claim 1 wherein said conductive plug protrudes both above and below said outsole and provides contact with both the ground and said first conductive layer.

8. The footwear of claim 1 wherein said outsole is fabricated from a poly foam material.

9. The footwear of claim 1 wherein said static interceptor means has a conductivity in the range of $10^5$ to $10^9$ ohms.

10. The footwear of claim 9 wherein said interceptor means is fabricated of a non volatile disipative resistance material.

11. The footwear of clam 1 wherein said conductive layer has a conductivity in the range of less than $10^3$ ohms.

12. The footwear of claim 1 wherein said conductive plug is fabricated from a polymer matrix.

13. The footwear of claim 12 wherein said polymer matrix contains conductive carbon.

14. The footwear of claim 12 wherein said polymer matrix contains a transaction metal.

15. The footwear of claim 14 wherein said transition metal is selected from the group consisting of copper, iron, cobalt and manganese.

16. The footwear of claim 1 wherein said conductive plug is molded into said outsole so that said conductive plus is in communication with said outsole and said static interceptor.

* * * * *